United States Patent [19]

Vigneron et al.

[11] Patent Number: 4,960,650

[45] Date of Patent: Oct. 2, 1990

[54] METHOD OF REPAIRING OR PROTECTING AN END OF A METAL TUBE IN A HEAT EXCHANGER AND SLEEVE FOR IMPLEMENTING SAME

[75] Inventors: Gilbert Vigneron, Boulogne sur Seine; Jean Bezier, Croix; Thong Nguyen-Thanh, Cernay la Ville; Pierre Vidal, Montigny sur Loing; Guy Zacharie, Fontainebleau; Lucien Guillemin, Bagneaux sur Loing, all of France

[73] Assignees: Societe Anonyme, Villacoublay; Electricite De France, Paris, both of France

[21] Appl. No.: 366,362

[22] Filed: Jun. 15, 1989

Related U.S. Application Data

[63] Continuation of Ser. No. 123,476, Nov. 20, 1987, abandoned.

[30] Foreign Application Priority Data

Nov. 21, 1986 [FR] France ..... 86 16231

[51] Int. Cl.[5] ..... F16L 55/16; F28F 11/02

[52] U.S. Cl. ..... 428/594; 29/523; 29/507; 29/402.16; 29/402.19; 138/97

[58] Field of Search ..... 29/523, 507, 402.16, 29/402.19; 428/575, 586, 577, 594; 138/98, 97; 165/76

[56] References Cited

U.S. PATENT DOCUMENTS

| | | | |
|---|---|---|---|
| Re. 30,802 | 11/1981 | Rogers | 29/523 |
| 3,064,344 | 11/1962 | Arne | 29/523 |
| 3,467,180 | 9/1964 | Pensotti | 29/507 |
| 3,792,603 | 2/1974 | Orain | 72/402 |
| 3,974,042 | 8/1976 | Angelini | 204/25 |
| 4,028,789 | 6/1977 | Loch | 29/402.16 |
| 4,368,571 | 1/1983 | Cooper | 29/523 |
| 4,411,456 | 10/1983 | Martin | 29/507 |
| 4,505,017 | 3/1985 | Schukei | 29/523 |
| 4,513,786 | 4/1985 | Sodergren et al. | 29/523 |
| 4,580,426 | 4/1986 | Zafred | 29/523 |
| 4,641,409 | 2/1987 | Schallenberger | 29/523 |
| 4,713,870 | 12/1987 | Szalay | 29/507 |

FOREIGN PATENT DOCUMENTS

| | | | |
|---|---|---|---|
| 0047407 | 3/1982 | European Pat. Off. . | |
| 0121137 | 10/1983 | European Pat. Off. . | |
| 0112612 | 7/1984 | European Pat. Off. . | |
| 0181250 | 5/1986 | European Pat. Off. . | |
| 15639 | 1/1982 | Japan | 29/523 |
| 471413 | 9/1937 | United Kingdom | 29/523 |

OTHER PUBLICATIONS

F. C. DCJs, "Sleeving Saves Nuclear Steam Generator Tubes", Power Engineering, Dec. 1981, vol. 85, No. 12, pp. 73–75.

Metals Handbook, 9th Ed., vol. 4, "Heat Treating", 1983, pp. 3–5, 451–452, 458 ∝ 459.

Metals Handbook, 9th Ed., vol. 6, "Welding, Brazing and Soldering", 1983, pp. 339–341, 856–859, 862, 889–895.

*Primary Examiner*—John J. Zimmerman

*Attorney, Agent, or Firm*—Sughrue, Mion, Zinn, Macpeak & Seas

[57] ABSTRACT

To repair a corroded region of the end of a heat exchanger tube, a sleeve is inserted, then expanded into the tube both in the area of the tube sheet and beyond the corroded area, then local welds are made in each of the expanded regions. Thereafter, the end of the sleeve is expanded against the tube in a region inside the tube sheet and above the local weld.

13 Claims, 1 Drawing Sheet

METHOD OF REPAIRING OR PROTECTING AN END OF A METAL TUBE IN A HEAT EXCHANGER AND SLEEVE FOR IMPLEMENTING SAME

This is a continuation of application Ser. No. 07/123,476, filed Nov. 20, 1987 now abandoned.

BACKGROUND OF THE INVENTION

This invention concerns a method for repairing or protecting a damaged or corroded area of the end of a metal heat exchanger tube, near the inside surface of its tube sheet, whereby a metal sleeve having an outside diameter slightly smaller than the tube's inside diameter is inserted into the tube to a sufficient depth to cover the damaged or corroded area, the end of the sleeve is engaged against the tube wall beyond the damaged or corroded area thereof, then the engaged end of the sleeve is locally welded to the inside of the tube such that the latter is partially penetrated and the end of the sleeve towards the outside surface of the tube sheet and the corresponding end of the tube is locally welded. The invention also concerns a sleeve which can be used with this method.

In heat exchangers made of tube bundles attached to thick tube sheets, one of the fluids, for example the heating fluid, flows inside the tubes, and the other, for example the heated fluid, circulates outside the tubes.

When, as a result of corrosion, a defect wears through the wall or walls of one or more tubes, causing even a small leak of one fluid into the other, several disadvantages appear, namely:

- loss of exchanger effectiveness, and consequently of the installation's efficiency,
- the risk of defect growth, to the point of complete rupture of the tube, which may then whip about and damage neighboring tubes,
- and in the case of a nuclear plant exchanger, especially in pressurized water reactor (PWR) steam generator boilers, possible leakage of radioactive fluid into nonradioactive fluid and contamination of the latter's circuit.

It has previously been proposed to eliminate to leak in a tube wall by plugging the two ends of the tube in the tube sheet or sheets. This can be done only for a limited number of tubes however, to avoid substantially reducing the flow of fluid processed in the exchanger.

Another proposed solution has been to stop the leak with the help of an internal sleeve installed either by mechanical or hydrostatic bulging, or by expansion with an elastomer ring, by explosive forming or by brazing.

Such methods are not fully satisfactory however, for securing the sleeve within the tube by mechanical or hydrostatic bulging, expansion with an elastomer ring, explosive forming or brazing induces stresses in the tube which are potential sources of corrosion that cannot be eliminated without the risk of spring-back or "debulging".

SUMMRY OF THE INVENTION

This invention is directed to providing a method for repairing or protecting a damaged or corroded area of the end of a tube, which avoids any danger of subsequent corrosion of the tube, especially such as would result from excessive residual stress being induced in the tube, while at the same time providing a rugged, absolutely fluid-tight mechanical protection.

The inventive method consists in effecting, prior to locally welding to the tube sheet the end of the sleeve toward the outside of the tube sheet, a localized expansion of the said sleeve end against the tube, in carrying out the local weld inside the expanded or bulged region with partial penetration of the weld into the tube, and in thereafter expanding the end portion of the sleeve against the tube in the region located on the inside of the tube sheet, above the local weldment.

The inventive method preferably further includes at least one of the following steps:

- Prior to inserting the sleeve into the tube, drill one or more small-diameter blind holes or through holes into the tube, slightly beyond the inside surface of the tube sheet.
- Locally bulge or expand the end of the sleeve towards the outside surface of the tube sheet in the open air, or in an inert gas atmosphere or with blown inert gas.
- Prior to inserting the sleeve into the tube, provide the end of the former intended to be expanded the tube near the outside of the tube sheet with a thin metallic coating which is a good heat conductor and is corrosion resistant.
- Prior to inserting the sleeve into the tube, provide the end of the former intended to be expanded against the tube near the outside of the tube sheet with a series of longitudinal grooves, and before making the weld, purge the air from the space between the tube and the sleeve by blowing inert gas through the grooves or vacuum sucking the grooves.
- Also provide longitudinal grooves in the other end of the sleeve and flush the air from the space between the tube and sleeve with inert gas or vacuum sucking.
- After welding the sleeve to the tube end towards the outside of the tube sheet, carry out several expansion passes to bulge the sleeve into the tube beyond the weldment.
- Weld the sleeve to the tube inwards of the ends of the sleeve.
- Engage the end of the sleeve with the tube beyond the damaged or corroded area by controlled deformation of the sleeve's diameter.
- Weld the sleeve to the tube beyond the damaged or corroded area of the tube by welding the edge of the sleeve itself.
- De-stress the weldment securing the bulged end of the sleeve to the inside of the tube beyond the damaged or corroded are using an internal inductor.

De-stress the region of the sleeve beyond the area bulged into the tube within the tube sheet by light bulging.

The invention also covers a sleeve for implementing the method of the invention, having an outside diameter slightly smaller than the inside diameter of the tube and a greater length than the damaged or corroded area, featuring either a thin, corrosion-resistant external metallic coating with good heat conducting properties towards one of its ends, or an area beginning at at least one of its provided with fine longitudinal grooves, or both.

There will now be described, by way of example and with reference to the appended drawings, the tube sheet-side ends of the tubes of a heat exchanger operating between the primary, radioactive water heated from passing through the core of a nuclear reactor and the secondary water, to be heated by indirect exchange of heat with the primary water, repaired by the method of the invention.

DESCRIPTION OF PREFERRED EMBODIMENTS

Figure 1:
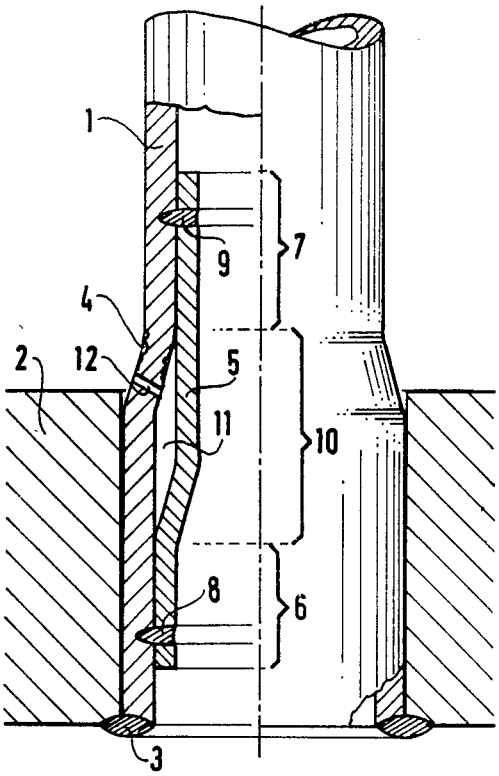
FIG. 1 shows an elevation and partial longitudinal cross section of the end of a tube near the tube sheet, equipped with an internal repair sleeve expanded and welded to the tube.

As can be seen in FIG. 1, the tube 1 is secured to the tube sheet 2 in the conventional manner, by expansion, and its bottom end toward the outside of the tube sheet is welded to the outside surface of the sheet, as represented by the weld bead 3.

The bulge taper area of the tube, near the inside surface of the tube sheet, has suffered stress corrosion and been damaged thereby as indicated at 4.

The repair is made with the help of an internal sleeve 5, having an outside diameter slightly smaller than the inside diameter of the tube, which covers the partially corroded area of the tube.

This sleeve 5 is attached in fluid tight manner to the tube in the two regions 6—within the tube sheet—and 7—beyond the tube sheet and the corroded area.

To effect the bottom bond in region 6, within the tube sheet, the sleeve is first expanded in the tube in a localized manner in that region. The bulging can be done in an inert gas atmosphere or with blown inert gas.

Then, the weld inwards from the edge of the sleeve is made by automatic inert gas shielded are welding, with the help of a device for welding the inside of pipes (this position allowing greater flexibility in the height adjustment of the welding torch). The preliminary bulging makes it possible to concentrate the heat in the region to be welded, which promotes weld penetration, contraction of the metal after welding and evacuation of the gas trapped between the tube and the sleeve. The weld should suitably penetrate into the tube, that is penetrate 20% to 75% of its thickness, without passing entirely through it.

Figure 3:
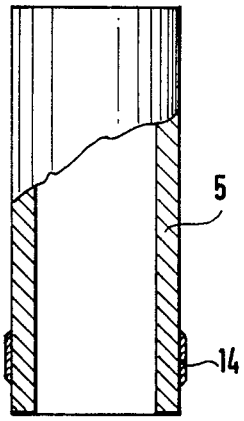
FIG. 3 represents an alternative embodiment of a repair sleeve, the lower end whereof is given a thin coating of a highly conductive, corrosion resistant metal.
Figure 4:
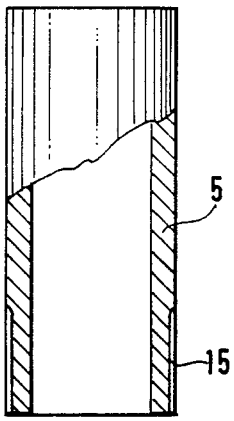
FIG. 4 represents an alternative embodiment of a repair sleeve, the lower end whereof is provided with grooves enabling air to be flushed out at the time of welding it to the tube.

To make easier the welding operation, the sleeve can be provided, in the region intended to accomodate the weld bead, and to each side of this region, with a thin deposit of a corrosion resistant, suitably heat conducting metal, such as chromium, obtained for example by metallization (deposit 14 of FIG. 3). Also, in order to further promote the evacuation of the air retained in the interstice between the tube and sleeve, the bottom end of the sleeve as far as the weld bead and a little beyond can be provided with fine longitudinal grooves, for example four grooves 90° apart (grooves 15 in FIG. 4). The air can be purged out either by blowing in inert gas or by applying a vacuum, if the assembly permits.

After making the bottom weld, the region 6 above said weld is expanded in several passes, thus providing a fluid-tight barrier and removing the region affected by the weld from the corrosive action of the water flowing around the tubes. No heat treatment for purposes of stress relief in the weld bead, that might otherwise have an adverse effect due to the presence of the tube sheet, is therefore any longer necessary.

Figure 2:
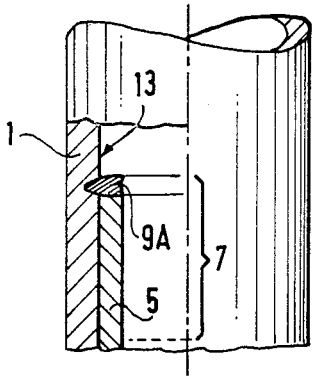
FIG. 2 shows an elevation and partial longitudinal cross section of an alternative repair in which the sleeve is welded to the tube along its top end.

The upper weld is then made, after engaging the sleeve with the tube by controlled deformation of its diameter, controlling the sleeve's expansion according to the number of expansion tool spindle rotations. This ensures good repeatability of satisfactory tube-sleeve contact—a necesary condition for ensuring a good assembly weld while limiting induced stressed in the tube. The upper weld can also be made inwards along the sleeve of the sleeve edge, for example at 20 to 30 mm inwards of the edge (weld bead 9 of FIG. 1). A welding alternative is to completely fuse the edge of the sleeve, as shown at 9A of FIG. 2. This alternative allows one to inspect the heat-affected region 13 of the tube, above the weld.

This type of weld bead is obtained by adjusting the position and angle of the welding electrode, or by suitable preparation, by machining, of the sleeve end.

Regardless of the position of the sleeve upper weldment, suitable stress relief can be provided therefor by means of a local heat treatment with an internal inductor.

In order to prevent a possible pressure rise in the space 11 between the tube and the sleeve due to leakage thereinto and accumulation therein of various residues, of gas or water, one or more holes such as 12 can be drilled into the tube, prior to installing the sleeve. These holes can be made as through-holes, as shown, or as blind holes, leaving a small thickness of tube metal to act as a safety diaphragm in the event of pressure rise in space 11. The hole or holes can also contribute to easier execution of the upper sleeve-to-tube joint, especially during the welding operation, when the entrapped gas might hinder closure of the weld pool.

Still in accordance with the invention, other types of welding can be used instead of the tungsten electrode-inert gas shielded (TIG) arc welding already mentioned, including laser welding or electron beam welding.

Weld quality can be checked by nondestructive testing means such as by endoscopic, dye penetrant, eddy current or ultrasonic inspection.

We claim:

1. A method for repairing or protecting a damaged or corroded area of the end of a metal heat exchanger tube near the inside surface of its tube sheet, comprising:

inserting a metal sleeve having an outside diameter slightly smaller than the tube's inside diameter into the tube to a sufficient depth to cover the damaged or corroded area, locally radially expanding the end of the sleeve towards the outside of the tube sheet against the tube, locally welding the end of the sleeve towards the outside surface of the tube sheet axially inwards from the end thereof and the corresponding end of the tube, and thereafter, expanding the end portion of the sleeve above the local weldment in the region located on the inside of the tube sheet thereby providing a fluid tight barrier between the local weldment and said damaged or corroded area and thereby removing the region affected by the weld from the corrosive action of the fluid flowing around the tube, and wherein the weld being axially inwards of the end of the sleeve allowing greater flexibility in height adjustment of a welding torch in making such welds by automatic inert gas shield are welding, and expanding and engaging the end of the sleeve against the tube wall beyond the damaged or corroded area thereof, then locally welding the engaged end of the sleeve beyond the damaged or corroded area to the inside of the tube such that the tube is partially penetrated by the weld.

2. Method according to claim 17, wherein the end of the sleeve towards the outside surface of the tube sheet is radially expanded in an inert gas atmosphere or with blown inert gas.

3. Method according to claim 17 whereby prior to inserting the sleeve into the tube, the end of the former intended to be radially expanded against the tube at the outside of the tube sheet is provided with a series of longitudinal grooves, and before making the weld, the air is purged from the space between the tube and the sleeve by blowing inert gas through said grooves or vacuum sucking said grooves.

4. Method according to claim 3 wherein, longitudinal grooves are also made in the other end of the sleeve and the air is flushed from the space between the tube and sleeve with inert gas or vacuum sucking, before making the weld therein.

5. Method according to claim 1, wherein the end of the sleeve is engaged with the tube beyond the damaged or corroded area by controlled deformation of the sleeve's diameter according to the number of rotations of an expansion tool spindle which provides more accurate control of radial deformation of said sleeve.

6. Method according to claim 17, wherein the weld securing the sleeve to the tube beyond the damaged or corroded area of the tube is made on the very edge of the sleeve.

7. Method according to claim 17 wherein the weldment securing the locally expanded end of the sleeve to the inside of the tube beyond the damaged or corroded area is stress-relieved with the help of an internal inductor

8. Method according to claim 17, whereby the region of the sleeve beyond the area bulged into the tube within the tube sheet is stress-relieved by light bulging.

9. A method according to claim 1, wherein prior to inserting the sleeve into the tube, at least one small-diameter bind hole is drilled into the tube, at a point slightly beyond the inside surface of the tube sheet.

10. The method according to claim 1, wherein the local welding of the engaged end of the sleeve to the inside of the tube beyond the damaged or corroded area is made axially inwards from the edge of the tube beyond the damaged or corroded area.

11. Method according to claim 1, wherein the welds securing the sleeve to the tube are made axially inwards of the ends of the sleeve to effect a very tight bond between the sleeve and the tube.

12. A repaired heat exchange tube, having a terminal zone radially expanded within a hole of a tube sheet and welded by its edge to the outer face of said tube sheet, and having fixed thereto on both sides of a damaged or corroded area beyond its zone within said tube sheet a sleeve having an outside diameter slightly smaller than the inside diameter of the tube in said zone, extending from within said zone to beyond said damaged or corroded area, said sleeve being welded to said tube by a first weld bead beyond the damaged or corroded area of the tube and near the end of the sleeve beyond said area, and by a second weld bead axially inwards from the edge of said tube welded to said tube sheet and from the edge of said sleeve within said zone, said sleeve being provided in the region on each side of said second weld bead with a thin, corrosion-resistant external peripheral coating of chromium with good heat conducting properties.

13. Method for repairing or protecting a damaged or corroded area of the end of a metal heat exchanger tube near the inside surface of its tube sheet, by inserting a metal sleeve having an outside diameter slightly smaller than the tube's inside diameter into the tube to a sufficient depth to cover the damaged or corroded area, locally radially expanding the end of the sleeve toward the outside surface of the tube sheet against the tube, locally welding the end of the sleeve towards the outside surface of the tube sheet axially from the end thereof and the corresponding end of the tube, with partial penetration of the weld into the tube axially inwards from the end of the sleeve, and thereafter radially expanding the end portion of the sleeve above the local weldment in the region located on the inside of the tube sheet to thereby provide a fluid tight barrier and to remove the region affected by the weld from the corrosive action of the fluid flowing around the tube and, wherein the weld being axially inwards of the end of the sleeve allows greater flexibility in height adjustment of a welding torch in making such welds by automatic inert gas shield arc welding, and expanding and engaging the end of the sleeve beyond the damaged or corroded area against the tube wall, and then locally welding the engaged edge of the sleeve to the inside of the tube such that the tube is partially penetrated by the weld, and wherein prior to inserting the sleeve into the tube, the end of the sleeve intended to be radially expanded against the tube near the outside of the tube sheet is provided with a thin, external, corrosion-resistant peripheral coating of chromium which is a good heat conductor in the region accomodating the bead of the weld to the tube, and to each side of this region.

* * * * *

UNITED STATES PATENT AND TRADEMARK OFFICE

CERTIFICATE OF CORRECTION

PATENT NO. : 4,960,650

DATED : October 2, 1990

INVENTOR(S) : Gilbert Vigneron et al

It is certified that error appears in the above-identified patent and that said Letters Patent is hereby corrected as shown below:

On the title page, item [73] Assignee, change "Societe Anonyme, Villacoublay; Electricite De France, Paris, both of France" to --Stein Industrie, Villacoublay; Electricite De France, Paris, both of France--.

Signed and Sealed this

Nineteenth Day of May, 1992

*Attest:*

DOUGLAS B. COMER

*Attesting Officer*

*Acting Commissioner of Patents and Trademarks*